United States Patent [19]

Jenkins et al.

[11] 4,379,371

[45] Apr. 12, 1983

[54] TRACK SKELETONIZER

[75] Inventors: Allan D. Jenkins, Maple Plain; John T. Appelen, Mound; Nils Lind, Minnetonka, all of Minn.

[73] Assignee: Railway Track-Work Company, Excelsior, Minn.

[21] Appl. No.: 245,348

[22] Filed: May 23, 1980

[51] Int. Cl.[3] ..... E02F 5/22

[52] U.S. Cl. ..... 37/104; 104/7 R; 104/7 A

[58] Field of Search ..... 37/104–107; 104/7 R, 7 A, 9; 171/16

[56] References Cited

U.S. PATENT DOCUMENTS

| | | | |
|---|---|---|---|
| 2,993,451 | 7/1961 | Peppin | 104/7 A |
| 3,685,157 | 8/1972 | Plasser et al. | 104/7 R |
| 3,832,952 | 9/1974 | Hurni | 104/7 B |
| 3,968,752 | 7/1976 | Theurer | 104/7 B |
| 4,108,076 | 8/1978 | Knape | 37/104 X |
| 4,253,256 | 3/1981 | Feliz | 37/104 |

FOREIGN PATENT DOCUMENTS

| | | | |
|---|---|---|---|
| 2853529 | 11/1979 | Fed. Rep. of Germany | 104/7 B |

*Primary Examiner*—E. H. Eickholt

*Attorney, Agent, or Firm*—Merchant, Gould, Smith, Edell, Welter & Schmidt

[57] ABSTRACT

An apparatus (10) for performing work on a railway roadbed is disclosed. The apparatus includes a mobile support framework (16), a front truck (18) and a rear truck (20). Leg assemblies (22, 24) connect each truck to the framework (16). Rail hooks (46, 48) selectively connect the framework (16) with rails (14). Outriggers (42, 44) raise the framework and a section of rail connected to the framework by the hooks with respect to the ground. A roadbed working tool (34) can be suspended below the framework by a hook mechanism (36). A powered handling boom mechanism (38) is supported on the framework for moving the tool with respect to the framework after the tool has been released from the framework by the hooks. An adjusting mechanism (52) moves each of the trucks (18, 20) laterally with respect to the lengthwise dimension of the framework (16).

42 Claims, 17 Drawing Figures

TRACK SKELETONIZER

TECHNICAL FIELD

The present invention relates to an apparatus for performing repair or maintenance work on a railway roadbed. More particularly, the present invention relates to improvements in an apparatus for performing plowing out of ballast material from beneath a railway track and for evening ballast with a sled.

BACKGROUND OF THE INVENTION

Numerous types of apparatus have been used in the past for performing a variety of repair and maintenance functions on railroad roadbeds. Various types of apparatus have been used to perform one or more of the following functions: lifting track from a roadbed; plowing ballast out from under track; depositing fresh ballast beneath track; leveling fresh ballast; removing broken or bad ties; inserting new ties; and realigning track.

One type of prior art apparatus has the capability of lifting track, plowing out ballast material, removing bad ties, and realigning track. This type of apparatus, however, has no provision for carrying a roadbed working tool such as a plow or sled. A separate additional vehicle, such as a flatcar, is required for carrying the plow or sled. A separate handling machine is also required for moving the plow or sled from the flat car to a location adjacent the apparatus. Prior art apparatus of this type has used winch and cable systems to pull a plow beneath the track and apparatus after it has been placed on the ground adjacent lifted track.

Apparatus which lift sections of track travel upon the track on wheeled trucks and utilize hydraulic outriggers to lift desired sections of track. When a section of track is lifted by such an apparatus, the wheels carried by the truck sometimes are lifted out of contact with the rails of the track. After the wheels have left contact with the rails, the rails can become misaligned with the wheels. In the past, bulldozers or jacks have been used to move the track back into alignment with the wheels of the apparatus when the apparatus is lowered. The present invention eliminates the need for using jacks or bulldozers to correct minor misalignments of the track with the wheels.

Plows and sleds of the prior art have used control pads at the rear of the tool to control the cross level at which the tool operates. These control pads have been discrete pads located on either lateral side of the tool with each having a relatively short lateral dimension. These control pads tend to leave small depressions within the roadbed. Such depressions do not promote adequate tie life. One feature of the present invention is directed to overcoming this disadvantage.

SUMMARY OF THE INVENTION

The present invention is directed to an apparatus for performing work on a railway roadbed. The apparatus includes a mobile support framework; front and rear trucks each rotatably supporting wheels for riding on the rails of a railway track; and a means for connecting each truck to the framework. A rail hook means is carried by the framework for selectively connecting the framework with the rails upon which the wheels are riding. A means is carried by the framework for raising the framework and a section of rail connected thereto by the rail hook means. A roadbed working tool can be selectively suspended from the framework; and motor means is provided for actuating the means which suspends the tool from the framework. The motor means moves the suspension means between a tool suspension position and a release position wherein the tool is free to drop from the framework. A powered handling boom is supported by the framework for moving the tool with respect to the framework after the tool has been released from suspension to the framework. An adjustment means is provided for moving each of the trucks laterally with respect to the lengthwise dimension of the framework.

The present invention is also directed to a roadbed working apparatus which utilizes a suspension means for selectively suspending a roadbed working tool from a support framework of the apparatus, together with a boom for handling the tool after it is released by the suspension means.

The present invention is also directed to a roadbed working apparatus comprised of a mobile framework carried on a railway track by wheels and including a railway hook for connecting the framework to rails and a mechanism for raising the framework and connected section of rail from the ground. An adjustment mechanism is provided in this apparatus for repositioning the wheels with respect to the track in a lateral direction should the wheels become misaligned with the track if they are lifted above the track.

The present invention is also directed to a roadbed working tool, such as a plow or sled, which utilizes a control pad that extends across substantially the entire lateral dimension or width of the tool.

By providing the apparatus with a mechanism for suspending a work tool beneath the framework of the apparatus, the requirement of an other vehicle for carrying a tool such as a plow or sled is done away with. By utilizing the boom of the present invention, accurate and easy handling of a tool is accomplished. The boom can take the tool from beneath the framework and position it to the side of a roadbed and, after the track is lifted, then pick up the tool and reposition it under the track. This is in contradistinction to the requirement of a separate machine for removing a tool from a flatbed car and positioning it adjacent a winch and cable device which is then used to drag the tool under a lifted section of track.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE DRAWINGS

FIGS. 1 and 1*a* are side elevational views illustrating an overall apparatus in accordance with the present invention;

FIG. 6 is a sectional view taken generally along line 6—6 of FIG. 1a;

FIG. 7 is a sectional view taken generally along line 7—7 of FIG. 1a;

FIG. 15 is a sectional view taken generally along line 15—15 of FIG. 1a; and

DETAILED DESCRIPTION OF THE INVENTION

Figure 1:
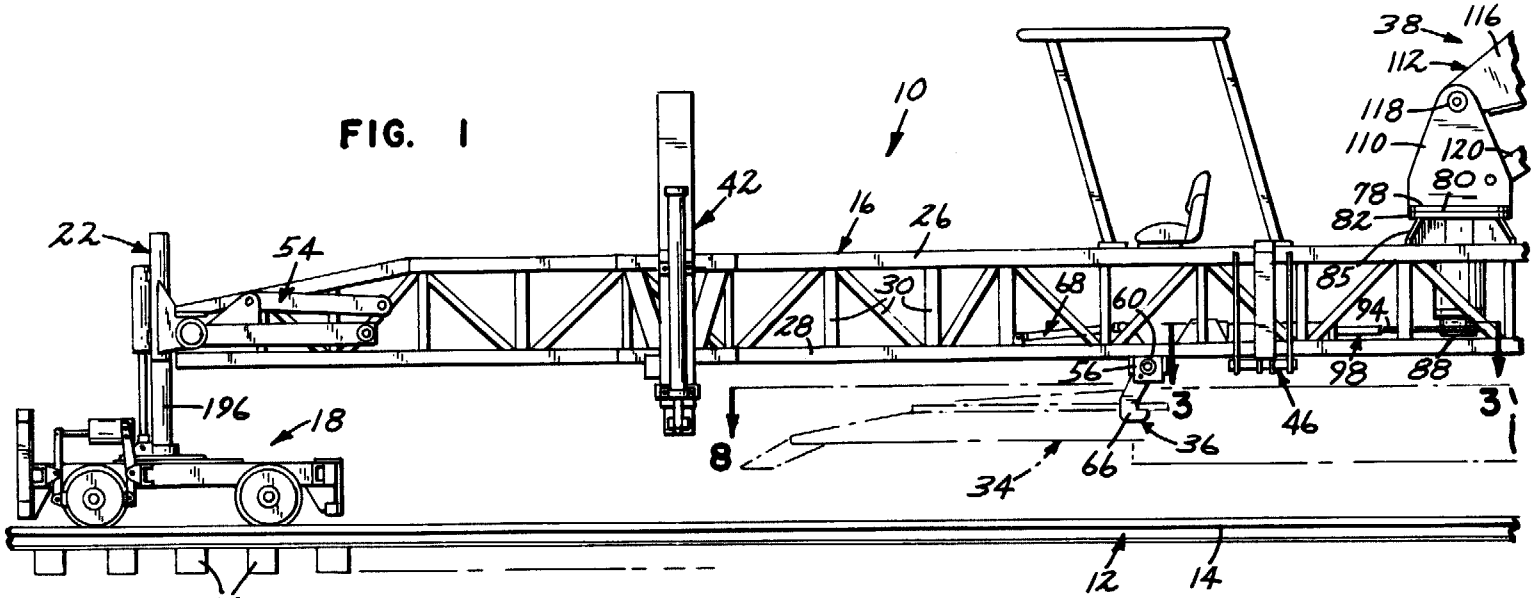
Figure 2:
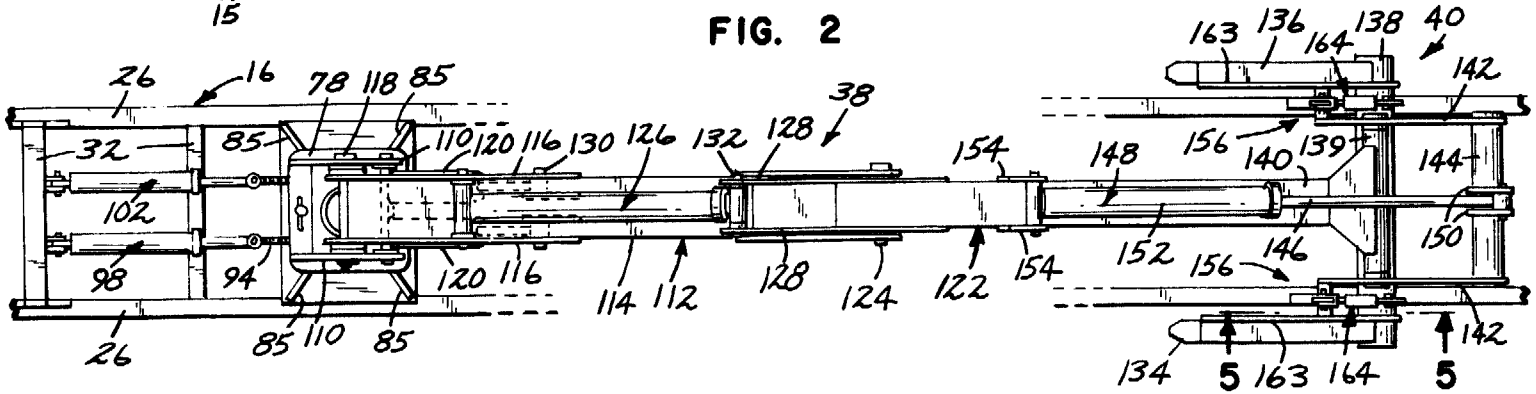
FIG. 2 is a top elevational view of the handling boom with portions of the framework deleted for purposes of clarity.
Figures 1A, 3:
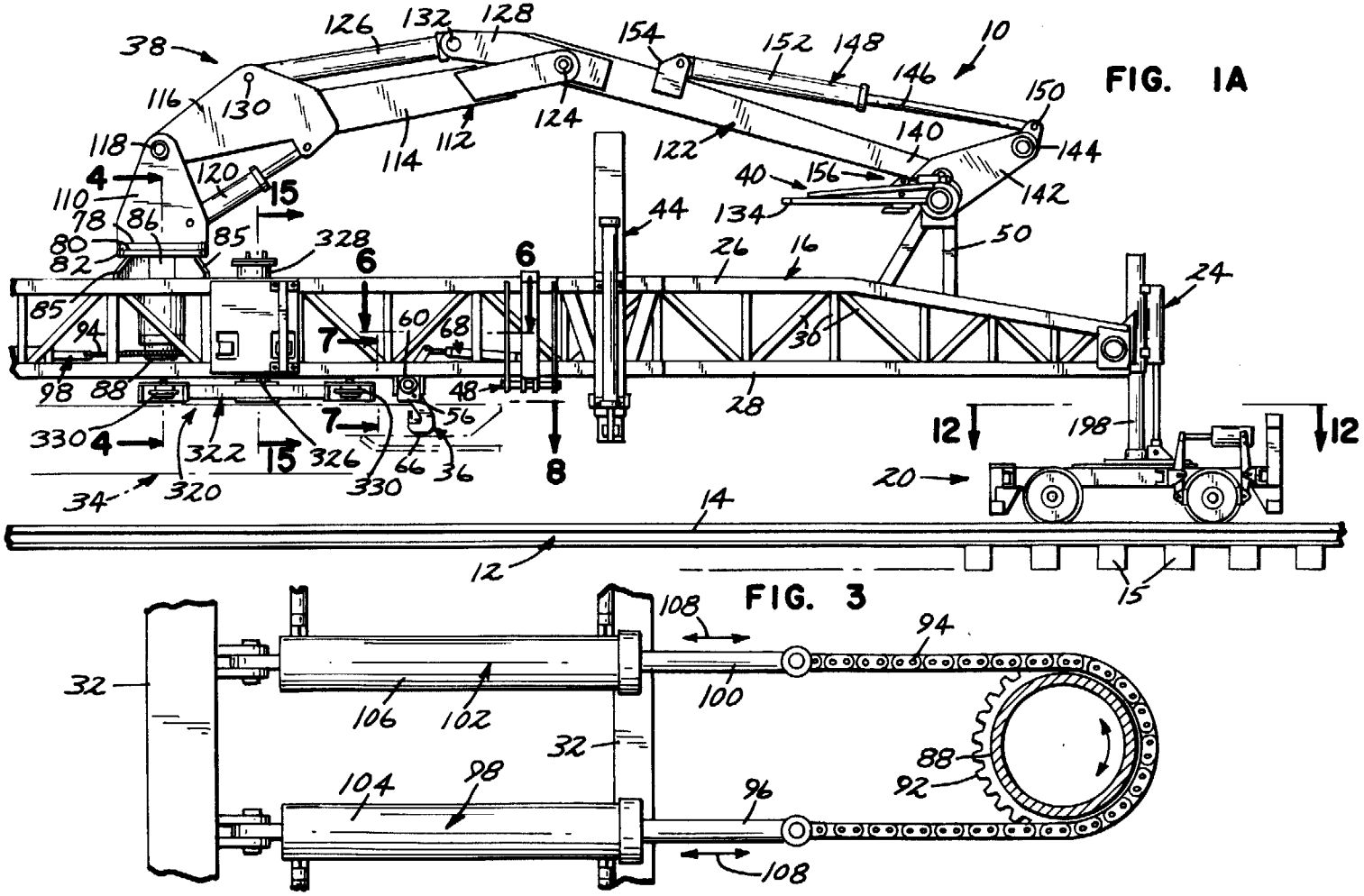
FIG. 3 is a sectional view taken generally along line 3—3 of FIG. 1.

Referring to the drawings in detail, wherein like numerals indicate like elements, there is shown in FIGS. 1 and 1a an apparatus for performing work on a railway roadbed, designated generally as 10. The apparatus 10 can be referred to in the art as a track skeletonizer. The apparatus 10 is shown supported upon a track 12 comprised of opposing parallel rails 14 (one of which is shown in FIGS. 1-1a) interconnected by ties 15. The apparatus 10 includes a framework 16 which is supported on the track 12 by a front truck assembly 18 and a rear truck assembly 20. A front leg assembly 22 connects the front truck assembly 18 to a front end of the framework 16 and a rear leg assembly 24 connects the rear truck assembly 20 to the rear end of the framework 16. Leg assemblies 22, 24 are of conventional design and, hence, will not be discussed in detail. Leg assemblies 22, 24 include conventional power means for raising and lowering the framework 16 with respect to truck assemblies 18, 24. The manner in which leg assemblies 22, 24 are coupled to truck assemblies, 18, 20 is not of conventional design and will be explained more fully hereinafter. Framework 16 includes longitudinally extending beams 26, 28 interconnected by vertical cross braces 30 and horizontal cross braces 32.

A roadbed working tool 34, which can be a plow or a sled, is preferably supported below the framework 16 by a suspension mechanism 36. A motor mechanism is provided for selectively engaging and disengaging the suspension mechanism 36 from the tool 34. The suspension mechanism 36 will be discussed in detail hereinafter. A handling boom mechanism 38 is rotatably supported on the framework 16. The boom mechanism 38 includes a fork 40 at its distal end for engaging and carrying the tool 34.

A pair of conventional front outriggers 42 (one of which is shown in FIG. 1) are attached to the framework 16 toward its front end and rearward of the front truck 18. A pair of conventional rear outriggers 44 (one of which is shown in FIG. 1a) are attached to opposite sides of the framework 16 toward its rear end and forward of rear truck assembly 20. A pair of conventional front rail hooks 46 (one of which is shown in FIG. 1) are attached to opposite sides of the framework 16 adjacent its center, and a pair of conventional rear rail hooks 48 (one of which is shown in FIG. 1a) are attached to opposite sides of the framework 16.

After the apparatus 10 is positioned at a site along the track 12 where roadbed work is to be performed, the tool 10 is removed in the following manner. Outriggers 42, 44 are lowered to the ground to increase the stability of the apparatus 10. The fork 40 is moved up and out of a retaining saddle 50 by the boom mechanism 38 and the mechanism 38 is raised until it will clear the top of rear outriggers 44. The boom mechanism 38 is then swung to one of the sides of the apparatus 10. The boom mechanism 38 is manipulated until the fork 40 engages the tool 34. The tool 34 is lifted slightly to disengage it from the suspension mechanism 36 which is thereafter moved to its release position. The tool 34 is then free to be carried out from under the framework 16 by the boom mechanism 38. The tool 34 is placed upon the ground to one side of the track 12, the fork 40 is disengaged and the boom mechanism 38 and framework 16 are raised approximately three feet. If conditions permit, the fork 40 may remain engaged with the tool 34. The powered lifting mechanism of the front and rear leg assemblies 22, 24 raises the front and rear truck assemblies 18, 20 to their maximum up position thus allowing the apparatus 10 to rest on the outriggers 42, 44. Using the outriggers 42, 44 the machine is lowered until the rail hooks 46, 48 can swing under the base of rails 14. The front and rear outriggers 42, 44 are alternately activated to raise the apparatus 10 and the track 12 coupled thereto. The track 12 is raised to a sufficient degree to provide space between the bottom of the ties 15 and the roadbed for insertion of the tool 34.

The fork 40 is thereafter again engaged with the tool 34 to lift it from the ground and position it under the raised track. The fork 40 is thereafter disengaged and the boom mechanism 38 is returned to its storage or travel position with the fork 40 received within saddle 50. The apparatus 10 is thereafter lowered by the outriggers 42, 44 until the rail hooks 46, 48 are free to swing up and out of engagement with rails 14. The power mechanism of leg assemblies 22, 24 positions the wheels of the truck assemblies 18, 20 back onto the rails 14. An adjusting mechanism 52 (shown in FIGS. 12-14) is provided for adjusting the lateral position of the truck mechanisms 18, 20 should the rails 14 become misaligned laterally with the wheels. Outriggers 42, 44 are thereafter pulled to their full up position and the apparatus 10 again rests upon rails through the of the truck mechanisms 18, 20.

The apparatus 10 is thereafter backed up until a conventional yoke device 54 is centered over an attachment point with the tool 34. The legs of the yoke 54 are thereafter connected to the tool 34 and the tool 34 and apparatus 10 are ready for attachment to a towing device. After attachment to a towing device, conventional working of the roadbed, such as plowing by a plow or leveling of roadbed by a sled can be accomplished.

Additional road working implements can be carried by the framework 16 and used in conjunction with the already described devices. For example, a conventional tie ejector can be carried by the framework 16. Also, a track aligning head liner 320 (shown in FIG. 15) can be carried by the framework 16. Having broadly described the operation of the apparatus 10, various novel components thereof will now be described in detail.

SUSPENSION MECHANISM

Figure 6:
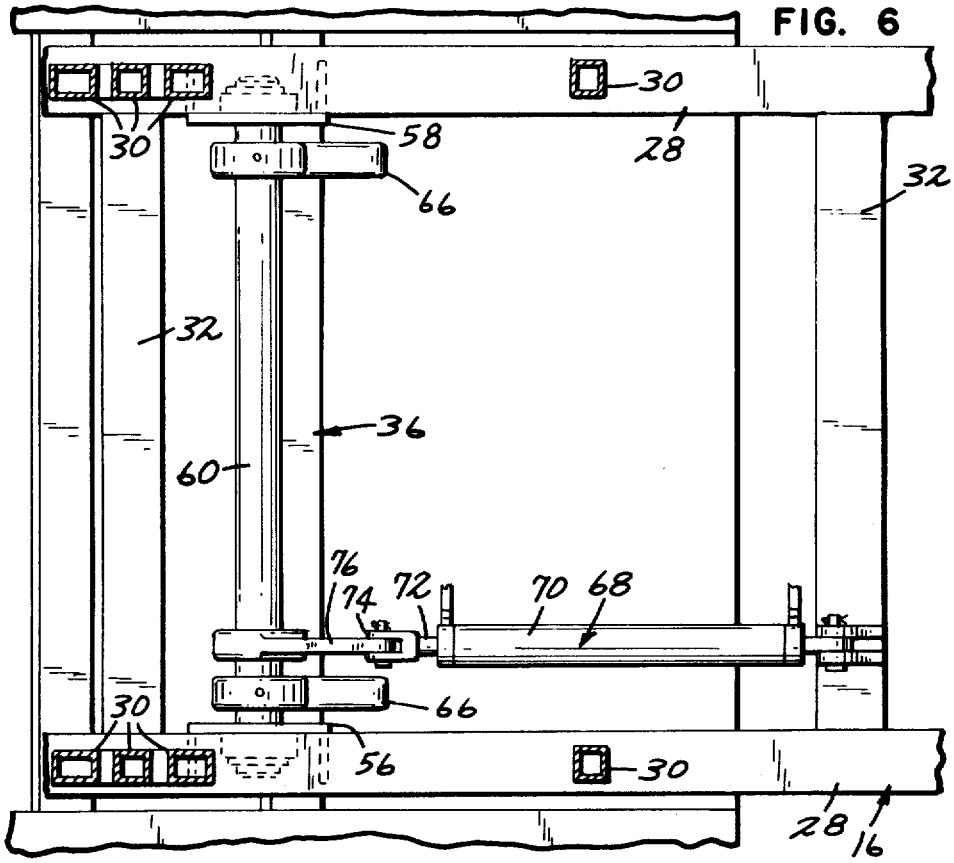
Figure 7:
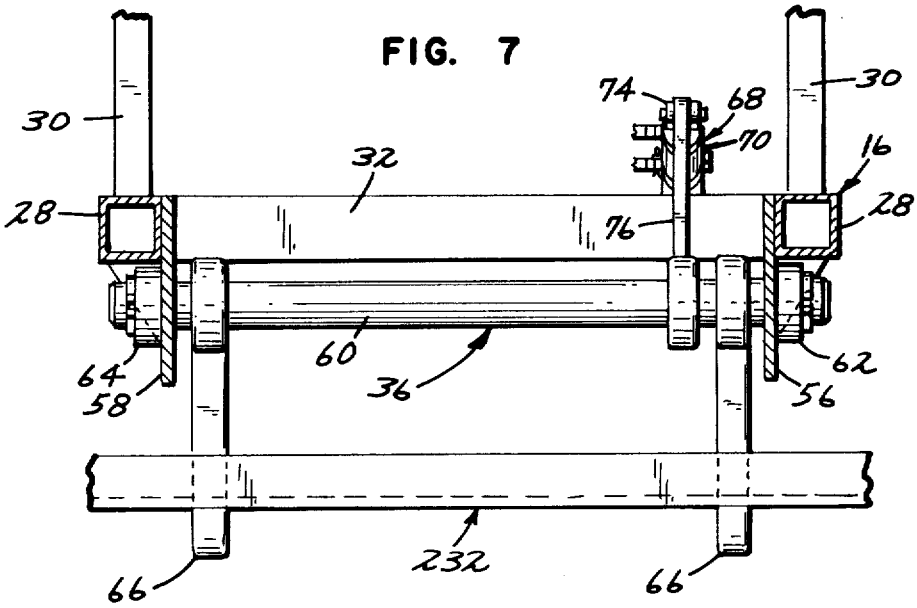

Details of the suspension mechanism 36 can be best seen in FIGS. 6 and 7. As seen therein, a support plate 56 is attached to and extends downwardly from one of the lower longitudinal beams 28 and a like support plate 58 is attached to and extends downwardly from the other longitudinal beam 28. A rod 60 is rotatably carried by bearings 62, 64 attached to support plates 56, 58. A pair of hooks 66 are fixedly attached adjacent opposite ends of the rod 60. As best seen in FIG. 1, hooks 66 have lips or upwardly facing bearing surfaces for contacting a portion of the tool 34 to support it in a suspended position below framework 16.

A hydraulic piston-cylinder mechanism 68 is coupled between the framework 16 and the rod 60 to provide the rotary force for moving hooks 66 between their tool engaging and tool releasing positions. Mechanism 68 includes a cylinder 70 which has one of its ends connected to one of the horizontal cross braces 32. A piston rod 72 is movable inward and outward of the cylinder 70 under hydraulic pressure. A yoke 74 is connected to the distal end of piston rod 72 and to an end of a crank arm 76. The crank arm 76 is fixed to the rod 60. In this manner, the reciprocal motion of piston rod 72 inward and outward of cylinder 70 rotates rod 60 to move hooks 66 into and out of engagement with tool 34. The suspension mechanism 36 at the forward portion of framework 16 is constructed similar to the suspension mechanism 36 shown in detail in FIGS. 6–7.

HANDLING BOOM MECHANISM

Figures 4, 5:
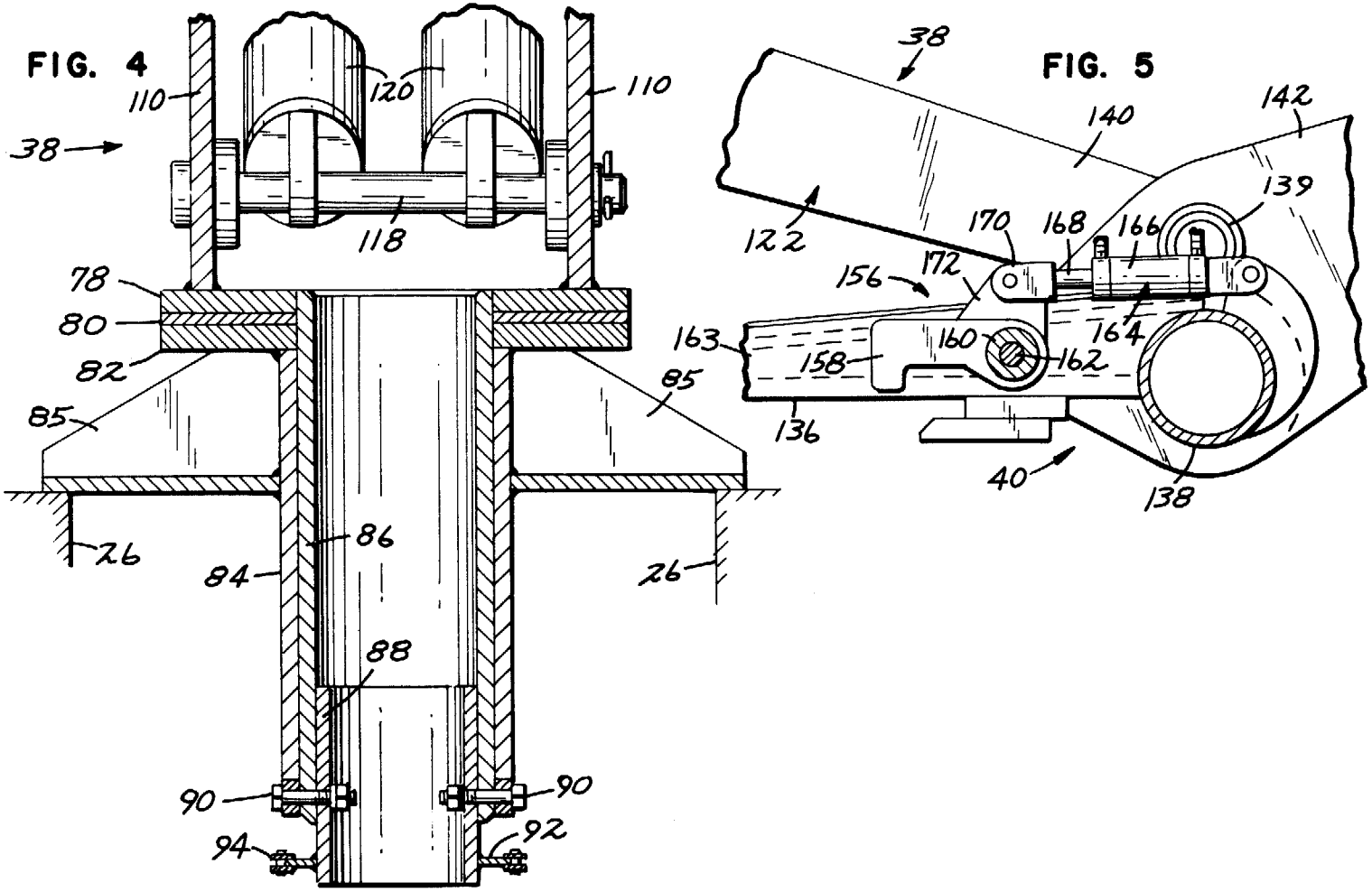
FIG. 4 is a sectional view taken generally along line 4—4 of FIG. 1*a;*
FIG. 5 is a sectional view taken generally along line 5—5 of FIG. 2.

Details of the handling boom mechanism 38 are best seen in FIGS. 2–5. As seen in FIG. 4, boom mechanism 38 is rotatably connected to framework 16 through a support base 78. Base 78 is supported for sliding rotary motion upon a bearing member 80. Bearing member 80 in turn is fixed to an annular base plate 82 which is fixedly connected to support tube 84. Support tube 84 is in turn fixedly connected to framework 16 by means of flange members 85. A rotatable tube 86 is fixedly connected to support base 78 and is supported for rotary motion within support tube 84. A coupling tube 88 is removably connected to a lower end of tube 86 by bolt means 90.

A gear 92 is fixedly connected to the outer surface of coupling tube 82 below the lowermost ends of tubes 84, 86. A drive chain 94 meshes with and is received about the gear 92. A first end of the drive chain 94 is connected to a piston 96 of a first hydraulic piston-cylinder mechanism 98, and a second end of drive chain 94 is connected to a piston 100 of a second hydraulic piston-cylinder mechanism 102. Cylinders 104, 106 of mechanisms 98, 102 are connected to adjacent cross braces 32. By alternately extending and retracting the pistons 96, 100 as shown by arrows 108, rotary motion is transferred to tube 86 and, hence, boom mechanism 38. Conventional hydraulic controls (not shown) are provided so that controlled rotary motion can be attained.

A pair of pivot plates 110 are fixedly attached to the support base 78 to pivotably support the remaining portion of the boom mechanism 38. A boom 112 including boom arm 114 and a pair of boom pivot plates 116 extend from pivot plates 110 and are pivotable with respect thereto about axle 118. Pivotal motion of boom 112 about axle 118 is provided by a pair of hydraulic piston-cylinder mechanisms 120. A jib 122 is pivotably connected to boom arm 114 about an axle 124. Power for pivoting the jib 122 with respect to the boom 112 about axle 124 is supplied by means of a jib hydraulic piston-cylinder mechanism 126 which is coupled between boom plates 116 and a first end 128 of jib 122 by means of pins 130, 132.

Fork mechanism 40 includes a pair of fork arms 134, 136 which are fixedly attached to a support cylinder 138. Support cylinder 139 is rotatably supported on a second end 140 of jib 122. A pair of fork pivot plates 142 have first ends fixedly connected to support cylinder 138 and support cylinder 139. Second ends of plates 142 are connected to a coupling cylinder 144. A piston 146 of fork actuating hydraulic cylinder mechanism 148 has its distal end connected to ears 150 which are attached to cylinder 144. A cylinder 152 of mechanism 148 is pivotably secured to a pair of mounting plates 154 which are attached to a medial section of jib 122. By extending and retracting piston 146, support cylinder 139 is rotated and pivots fork arms 134, 136.

So that fork arms 134, 136 can positively engage the tool 34 a clamping mechanism 156, best seen in FIG. 5, is provided. A clamping mechanism 156 is provided laterally inward of each fork arm 134, 136. Each clamping mechanism 156 is constructed alike and, hence, only one mechanism 156 is shown in detail in FIG. 5.

Clamping mechanism 156 includes a pivotable clamp arm 158 which is fixed to rotatable cylinder 160. Cylinder 160 is rotatably carried by a pin 162 which is carried between an upright flange 162 of a respective fork arm 134, 136 and one of the fork pivot plates 142.

A hydraulic piston-cylinder mechanism 164 provides the mode of power for pivoting clamp arm 158 between a clamping and unclamping position. A cylinder 166 of mechanism 164 is connected to support cylinder 138 and a distal end of a piston 168 of mechanism 164 is connected via a yoke 170 to an ear 172. The ear 172 is fixedly connected to rotatable cylinder 160. In this manner, the extending and retracting motion of piston 168 rotates cylinder 160 to pivot clamping arm 158.

Conventional hydraulic controls (not shown) are provided for the various hydraulic piston-cylinder mechanisms of boom mechanism 38 so that the boom mechanism 38 and the fork mechanism 40 can be accurately controlled to move tool 34.

LATERAL TRUCK ADJUSTING MECHANISM

Figure 12:
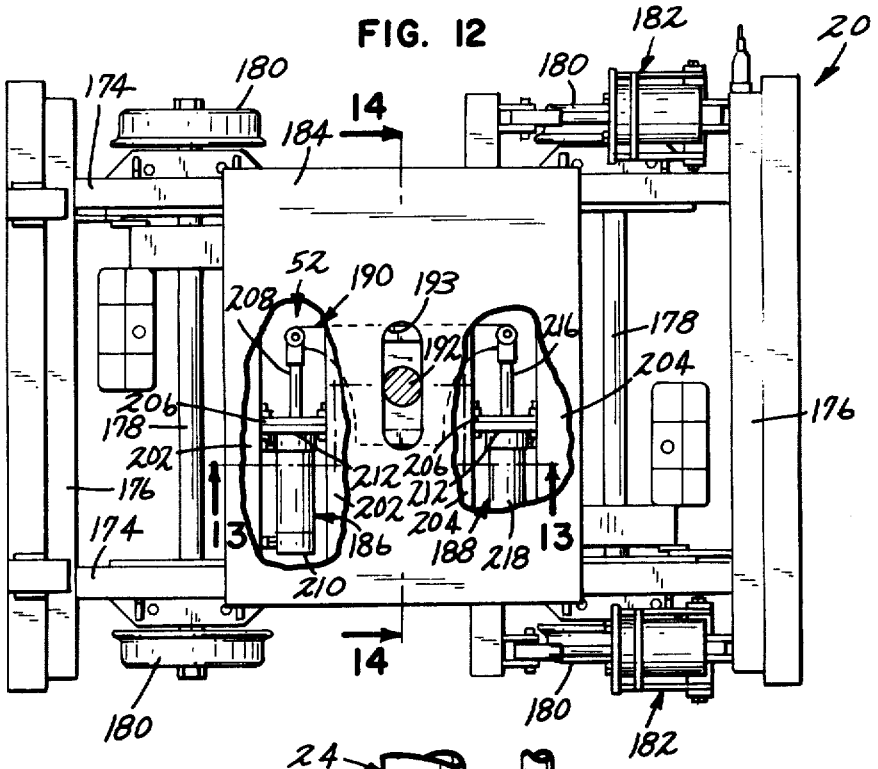
FIG. 12 is a sectional view taken generally along line 12—12 of FIG. 1a, portions being broken away and portions being omitted for clarity.
Figure 13:
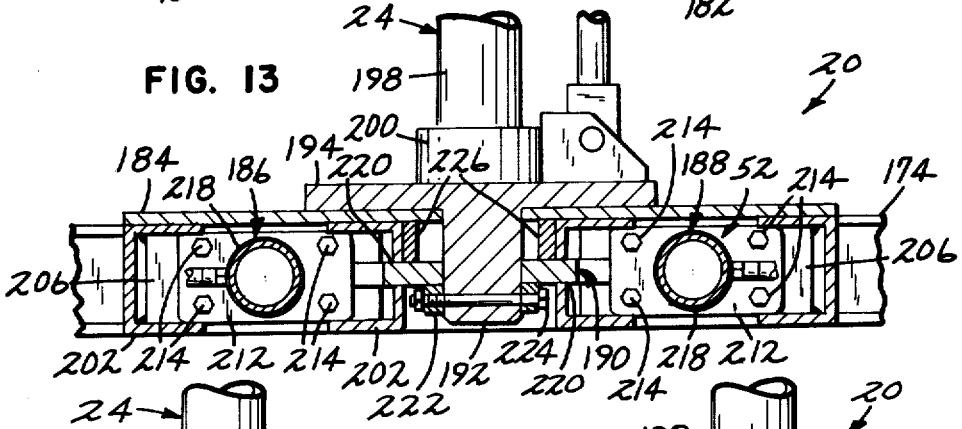
FIG. 13 is a sectional view taken generally along line 13—13 of FIG. 12.
Figure 14:
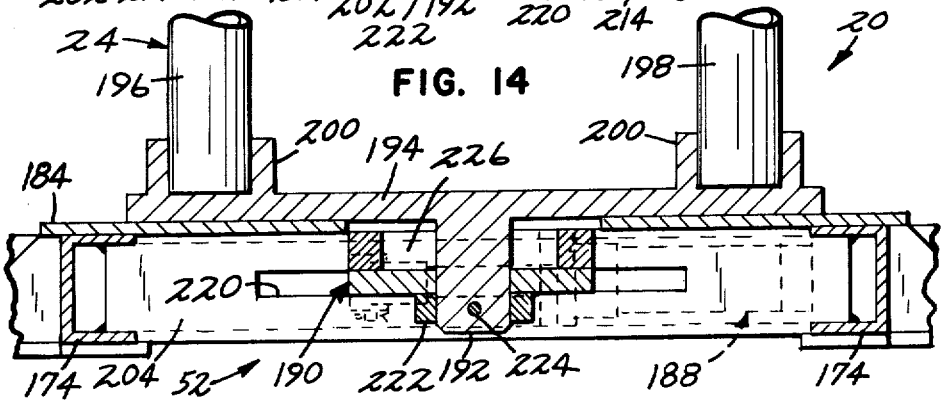
FIG. 14 is a sectional view taken generally along line 14—14 of FIG. 12.

Details of the adjusting mechanism 52 for aligning the truck mechanisms 18, 20 with respect to rails 14 is best seen in FIGS. 12–14. Truck mechanism 20 is shown in detail therein, with the understanding that truck mechanism 18 is similarly constructed.

As seen therein, truck assembly 20 includes longitudinal beams 174 and lateral beams 176 connected to one another to form a generally rectangular framework. Axles 178 are rotatably supported by the longitudinal beams 174 and carry wheels 180. A conventional braking mechanism 182 is also carried by the truck mechanism 20 for braking wheels 180.

A base plate 184 extends between opposed longitudinal beams 174 and is affixed to the tops thereof. Adjusting mechanisms 186, 188 are connected to leg assembly 24 through a yoke 190 and a pin 192 of a base 194 of leg assembly 24, which extends through a slot 193 through base plate 184. FIG. 13 illustrates a pair of lateral spaced legs 196, 198 of leg assembly 24 each supported in a tubular retainer 200 extending from a base 194.

A first pair of U-shaped channels 202 extend laterally between opposing longitudinal beams 174 and are attached thereto within open U-shaped channels of beams 174. U-shaped channels 202 are used to support hydraulic mechanism 186. A similar pair of U-shaped channels 204 extend between and are attached to beams 174 for supporting hydraulic mechanism 188. A plate 206 extends between opposing channel members 202 and is fixed, preferably by welding, within open channels of the members 202. Plate 206 has a hole through it through which a piston 208 of mechanism 186 can move. A cylinder 210 of mechanism 186 has a plate 212 attached to it. Plates 206, 212 are attached to one another by bolts 214. Mechanism 188 similarly includes a piston 216 and a cylinder 218 attached to channel members 204 by means of plates 206, 212 and bolts 214.

Piston 208 is removably coupled to one arm of yoke 190 and piston 216 is removably coupled to the other arm of yoke 190. As seen in FIG. 12, yoke 190 extends rearwardly and inwardly toward cylinders 210, 218 from its point of attachment to pistons 208, 216. As seen in FIGS. 13 and 14, innermost channel members 202, 204 are provided with slots 220 for slidably receiving portions of yoke 190 during the relative motion between framework 16 and truck mechanism 20. Pin 192 is coupled to yoke 190 by passing through a hole therein, and is removably affixed thereto by means of a collar 222 attached to the pin 192 below yoke 190 by means of bolt or pin 224. A pair of upright edge bars 226 are attached to the upper surface of yoke 190 adjacent an inwardly facing surface of innermost U-shaped channel members 202 and 204. Edge bars 226 serve to keep yoke 190 and, hence, base 194 in alignment with channel members 202, 204 and the truck mechanism 20.

Adjusting mechanism 52 operates in the following manner to align wheels 180 with rails 14 should misalignment occur while wheels 180 have been lifted out of contact with rails 14. When wheels 180 and truck mechanism 20 are out of contact with rails 14, truck assembly 20 is suspended from leg assembly 24 by means of the collar 222 attached to pin 192. If lateral misalignment of wheels 180 is noticed, hydraulic pressure is applied to cylinders 210, 218. Pressure in the cylinders 210, 218 causes relative motion between the cylinders 218, 210 and yoke 190 through the pistons 208, 216. Since in the suspended position of truck 20 framework 16 and leg assembly 20 are fixed relative to the ground by means of outriggers 42, 44, cylinders 210, 218, which are attached to truck mechanism 20, move relative to the framework 16. Appropriate conventional hydraulic controls (not shown) are provided so that the motion can be accurately controlled to realign wheels 180 with rails 14. As mentioned above, the utilization of adjusting mechanism 52 eliminates the possibility of bending rails by means of jacks and bulldozers when lateral wheel to rail misalignment occurs.

WORK TOOL AND CONTROL PAD

Figure 8:
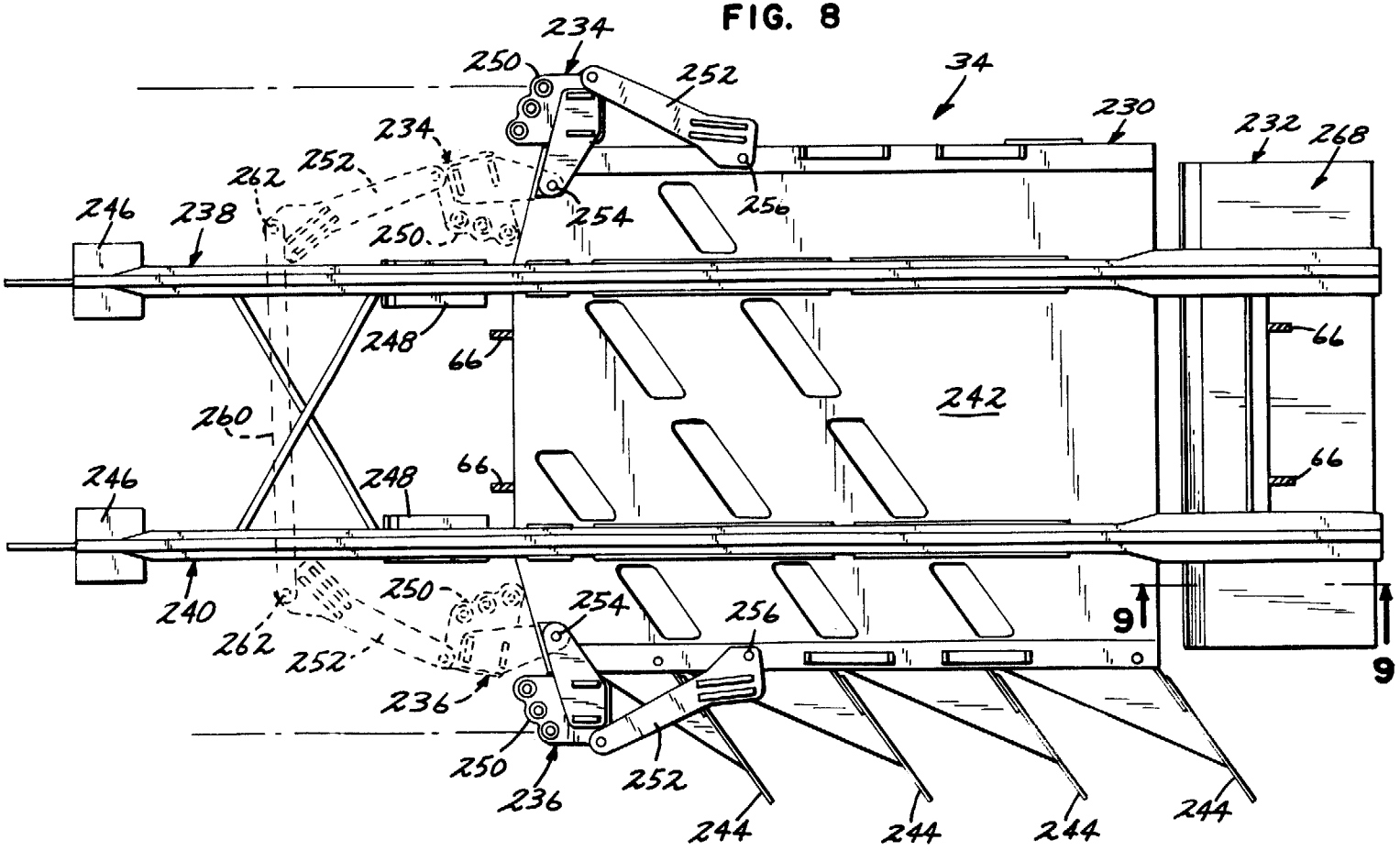
FIG. 8 is a sectional view taken generally along line 8—8 of FIGS. 1-1a, illustrating towing ears in an operative towing position in full line and in a transporting position in dashed line.
Figure 10:
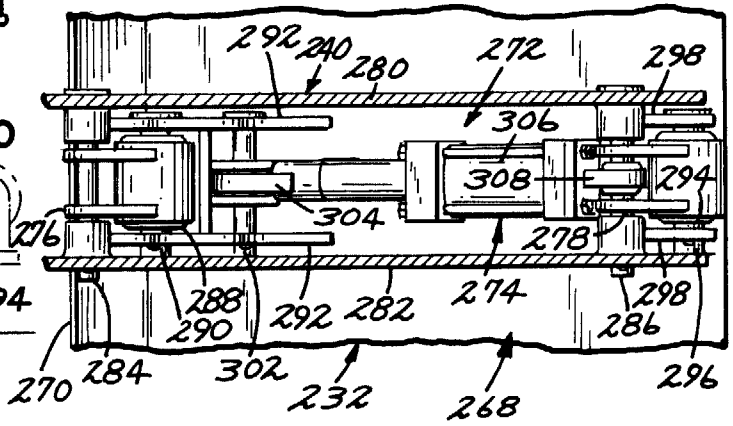
FIG. 10 is a sectional view taken generally along line 10—10 of FIG. 9.
Figure 9:
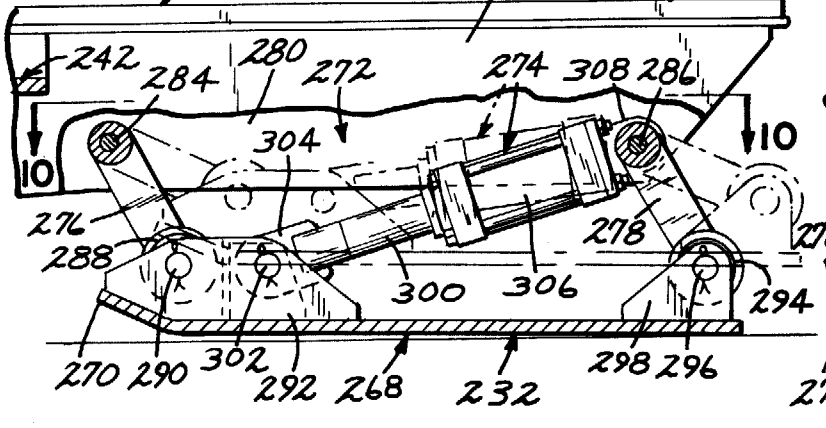
FIG. 9 is a sectional view taken generally along line 9—9 of FIG. 8.
Figure 11:
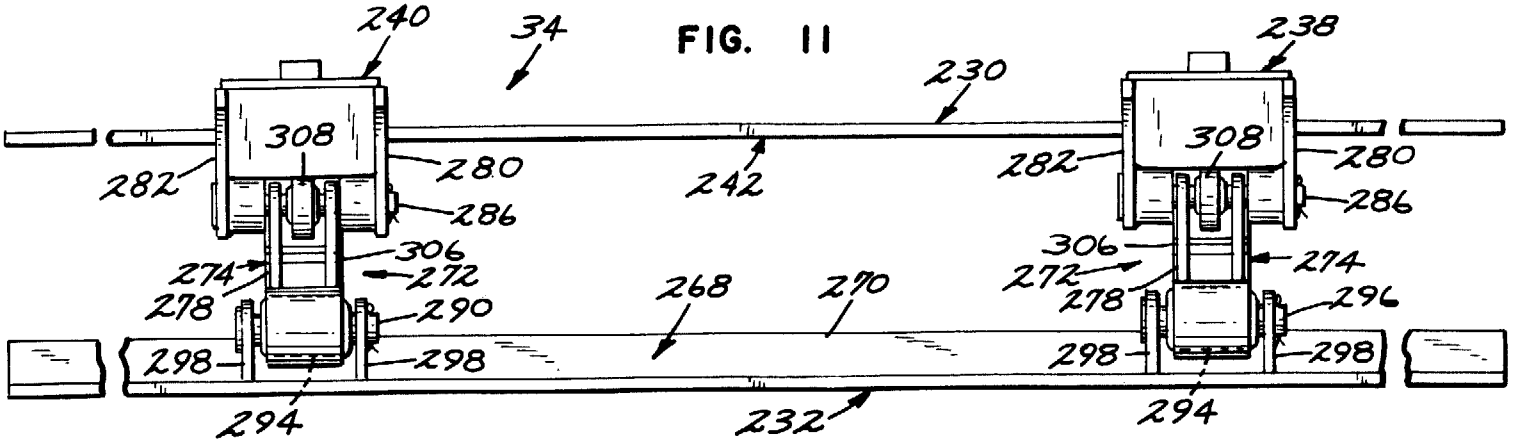
FIG. 11 is an elevational view as seen generally from right to left of FIG. 9.

FIG. 8 illustrates a plow-type work tool 230. FIGS. 9–11 illustrate a control pad 232 attached to the plow 230, it being understood that control pad 232 can be used with a sled-type work tool such as diagrammatically illustrated in FIGS. 1–1*a*.

Except for the construction of tow ears 234, 236 and control pad 232, the plow 230 is of conventional design and, hence, will only be described briefly. A pair of runner assemblies 238, 240 extend along the top lengthwise dimension of the plow 230. A plow frame or plate 242 is attached to the underside of runner assemblies 238, 240 over a portion of their length. Plow blades 244, which perform the ballast plowing function, extend downwardly from the plow frame 242. A lower runner assembly (not shown) extends along a portion of the front end of plow 230 beneath the top runner assemblies 238, 240. Nose tip assemblies 246 and front skid pads 248 serve as front ground contacting surfaces of the plow.

Tow ear assemblies of the prior art have been generally bolted to the sides of a plow/sled. When transporting such a prior art plow/sled, the tow ears frequently had to be unbolted and removed from their laterally outwardly extending position because of width restrictions along the railway. The tow ear assemblies 234, 236 of the present invention are pivotably secured to the plow 230 so that they may be moved from a laterally outward extending towing position as shown in full lines to a transporting position shown in dashed lines in FIG. 8. Each ear 234, 236 includes a forward coupling 250, which is used to connect the ear 234 to a towing cable and a positioning plate 252 for securing the ear 234 in either its towing or transporting position. The coupling plate 250 is pivotably mounted to the plow frame 242 by pin 254 and the positioning plate 252 is pivotably connected to the coupling plate 250 by pin 256. As shown in full lines, towing ear 234 can be secured to its towing position by securing positioning plate 252 to the plow frame 242 by means of a pin 256. When the plow 230 is being transported beneath the framework 216, towing ears 234, 236 are pivoted to the dashed line position and a securing strap 260 is attached to positioning plates 252 by pins 262. The requirement of bolting and unbolting towing ears, as practiced with prior art working tools, is thus eliminated.

The control pad assembly 232 includes a pad or plate 268 adapted to slide along the ballast surface behind the plow blades 244. As seen in FIG. 11, the pad 268 extends across substantially the entire width of the plow 230. The width of the plate 268 is sufficient to extend across the entire width of a track with which the plow is being used. As seen in FIG. 9, the pad 268 has an upwardly turned front edge 270. A pair of like control mechanisms 272 are connected between the pad 268 and each of the top runners 238, 240 to adjust the disposition of the control pad 268 with respect to the top runners. Each of the control mechanisms 272 is independently operable so that either side of the pad 268 can be adjusted independently. By adjusting the relative positions of opposite ends of the pad 268 with respect to the top runners, the level at which the plows cut through ballast can be adjusted. Since each control mechanism 272 is constructed alike, only one of the mechanisms will be discussed in detail.

The control mechanism 272 includes a hydraulic piston-cylinder mechanism 274, a forward link 276 and a rear link 278. The rear portion of runner assembly 240 includes a pair of downwardly extending flanges 280, 282. A pin 284 is carried between the flanges 280, 282. Link 276 has a first end pivotably carried about pin 284. As seen in FIG. 10, link 276 can be comprised of a pair of plates. A second pin 286 is carried between flanges 280, 282 at the opposite or rearmost end of pad 268. A first upper end of link 278, which can include a pair of plates, is pivotably received about pin 286. A second lower end of link 276 is attached to a rubber bushing 288. The bushing 288 is rotatably received about a pin 290 which is carried between a pair of upright mounting plates 292 attached to an upper surface of pad 268. A second end of link 278 is attached to a rubber bushing 294. The rubber bushing 294 is rotatably received about a pin 296 which is carried between a pair of upright mounting plates 298 attached to an upper rear surface of pad 268.

A piston 300 of mechanism 274 is pivotably received about a pin 302 which is carried between mounting plates 290 as at 304. A cylinder 306 of mechanism 274 is pivotably coupled to pin 286 as at 308.

The cross level at which the plow moves through the ballast can be controlled by shortening and lengthening the overall length of the hydraulic piston-cylinder mechanism 274. As seen in FIG. 9 in full lines, the piston 300 is extended out of the cylinder 306 so that links 276, 278 pivot downward to increase the distance between the pad 268 and the runner assembly 240. By shortening the effective length of mechanism 274, the links 276, 278 pivot upward, as seen in phantom lines in FIG. 9, to shorten the distance between pad 268 and runner assembly 240. By shortening the distance between pad 268 and runner assembly 240 on one side of the plow 230, the plow blades on that side of plow 230 are forced deeper into the ballast to slant the level at which the ballast is being plowed out in that direction. By utilizing rubber bushings 288, 294 each assembly 272 can be adjusted independently and certain amount of twisting or misaligning is allowed between the rubber bushings and pins about which they are received. Since control pad 268 is a single integral piece across the entire width of the plow, an even amount of foundation is left behind the plow after it passes through the ballast. This is a contradistinction to prior art control pads which utilized small pads on either lateral side of the plow. While the control pad 232 has been illustrated in use with a plow 230, it should be understood that the control pad can also be used with a sled as shown diagrammatically in FIG. 1*a*.

Liner Head

Figure 15:
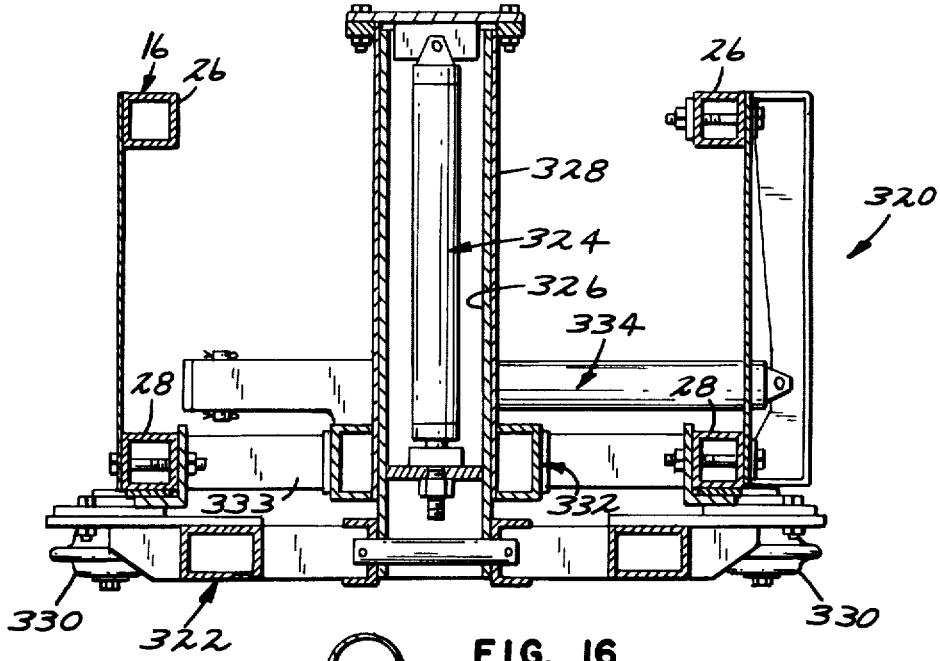
Figure 16:
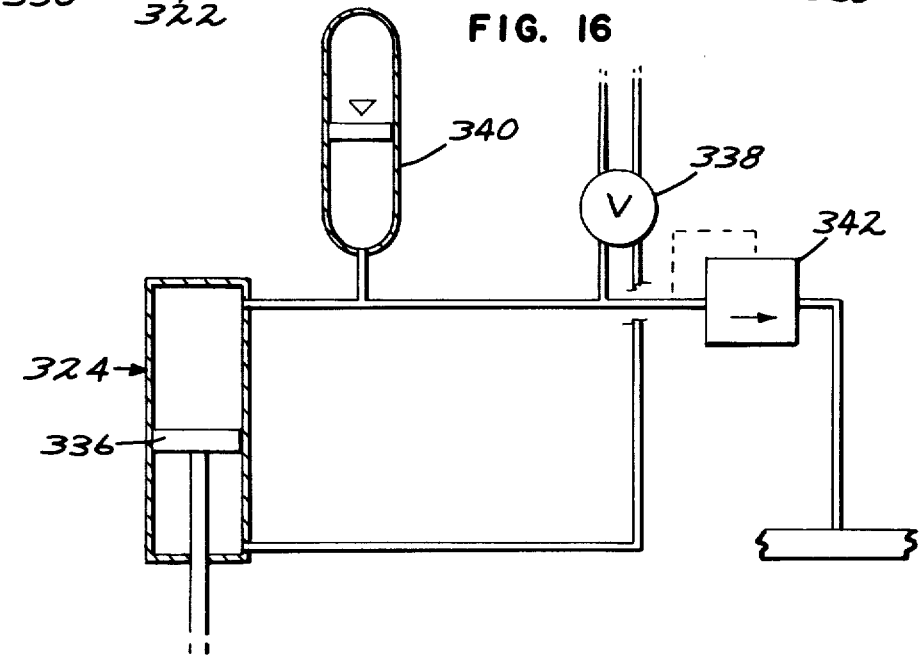
FIG. 16 is a diagram of a hydraulic circuit for controlling vertical motion of a liner head.

FIG. 15 illustrates a conventional liner head 320 attached to the framework 16 of the present invention. FIG. 16 illustrates a novel hydraulic circuit for controlling the downward pressure applied by the head liner upon rails 14.

Since the head liner 320 is of conventional design, it will be described only briefly herein. A wheel support frame 322 is movable up and down by means of a hydraulic piston-cylinder mechanism 324 which extends inside an inner tube 326 upwardly and downwardly with respect to an outer tube 328. Four rail contacting wheels 330, two of which are shown in FIG. 15, are supported by the frame 322. A lateral motion carriage 332 is connected to outer tube 328 and mounts on guide bars 333 to move transversely of member 28 of framework 16. A pair of hydraulic piston-cylinder mechanisms, one of which is shown in FIG. 15 and designated as 334, are connected between the carriage 332 to provide lateral motion longitudinally of bars 333 for the carriage 332 and, hence, the frame 322. Conventional hydraulic controls (not shown) are used with the piston-cylinder mechanisms which provide the lateral movement to laterally realign rails.

FIG. 16 illustrates a novel hydraulic circuit for use in controlling the downward motion caused by mechanism 324. Hydraulic fluid is applied to either side of a piston 336 of mechanism 324. The amount of hydraulic pressure supplied to either side of the piston 336 is controlled by a valve 338. So that vertical deviations or humps in the rails can be vertically absorbed, an accumulator 340 is incorporated into the hydraulic circuit. Without the accumulator 340, a vertical deviation in the rail upon which wheels 334 are riding could cause derailing of wheels 180. A release valve 342 is interposed in the circuit between a reservoir and the mechanism 324 to absorb any high pressure shocks which accumulator 340 is incapable of accommodating. Accumulator 340 does allow wheels 334 to absorb normal vertical deviations in the rails 14 without causing derailing of the apparatus 10.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangements of parts, within the principle of the invention, to the full extend extended by the broad general meaning of the terms in which the appended claims are expressed.

What is claimed is:

1. Apparatus for performing work on a railway roadbed comprising:
   - a mobile support framework;
   - a front truck and a rear truck, each of said trucks rotatably supporting wheels for riding on rails of a railway track;
   - means for connecting each truck to said framework;
   - rail hook means carried by said framework for selectively connecting said framework with the rails upon which said wheels are riding;
   - means carried by said framework for raising said framework and a section of rail connected to said framework by said rail hook means with respect to the ground;
   - a roadbed working tool;
   - suspension means carried by said framework for selectively suspending said tool from said framework;
   - motor means for moving said suspension means between a tool supporting position wherein said tool is suspended from said framework and a release position wherein said tool is free to drop from said framework;
   - powered handling boom means supported by said framework for moving said tool with respect to said framework after said tool has been released from said framework by said suspension means; and
   - adjusting means for moving each of said trucks laterally with respect to the lengthwise dimension of said framework.

2. Apparatus in accordance with claim 1 wherein said handling boom means includes a generally vertically extending support member, means for rotatably carrying said support member on said framework for rotation about a generally vertical axis, arm means pivotably connected to said support member for pivoting about a generally horizontal axis, coupling means attached to said arm means for coupling said boom means to said tool, first power drive means for rotating said support member, and second power drive means for pivoting said arm means about its axis.

3. Apparatus in accordance with claim 2 wherein said drive means includes a gear connected to said support member for rotation therewith, a length of chain passed about a portion of said gear, and means for moving said chain with respect to said gear to rotate said gear and the attached support member.

4. Apparatus in accordance with claim 3 wherein said means for moving said chain includes a pair of hydraulic piston-cylinder mechanisms, a first end of said chain being connected to the piston rod of one of said hydraulic piston-cylinder mechanisms, and the other end of said chain being connected to the piston rod of the other hydraulic piston-cylinder mechanism, whereby the motion of said pistons moves said chain to rotate said support member.

5. Apparatus in accordance with claim 2 or 3 wherein said arm means includes a boom pivotably connected to said support member for pivoting motion about a generally horizontal axis, a jib pivotably connected to said boom at a location distant from the pivotable connection of said boom to said support member for pivotable motion about a generally horizontal axis, and said second power drive means includes a boom hydraulic piston-cylinder mechanism connected between said support member and said boom for pivoting said boom with respect to said support member and a jib hydraulic piston-cylinder mechanism connected between said boom and said jib for pivoting said jib with respect to said boom.

6. Apparatus in accordance with claim 5 wherein said coupling means includes a fork pivotably connected to said jib, a tilt hydraulic piston-cylinder mechanism for pivoting said fork with respect to said jib about a generally horizontal axis.

7. Apparatus in accordance with claim 1, 2 or 3 wherein said suspension means includes a plurality of hooks pivotably mounted to said framework and motor means for pivoting said hooks between a holding position wherein said hooks engage said tool and a release position wherein said hooks disengage from said tool.

8. Apparatus in accordance with claim 7 wherein a first pair of said hooks are laterally aligned and depend downwardly from the bottom of said frame and wherein said second pair of hooks are laterally aligned and depend downwardly from the bottom of said frame.

9. Apparatus in accordance with claim 8 wherein said first pair of hooks are fixedly attached to a first rod for rotation therewith and said second pair of hooks are fixedly attached to a second rod for rotation therewith, said motor means includes a first hydraulic piston-cylinder mechanism connected to said first rod by a first crank arm and a second hydraulic piston-cylinder mechanism connected to said second rod through a second crank arm.

10. Apparatus in accordance with claim 1, 2 or 3 wherein each of said trucks includes a truck frame and a pair of axles carried by each truck frame for supporting said wheels, and wherein said connecting means includes a leg assembly having one portion fixedly connected to said framework and another portion connected to one of said truck frames through said adjusting means.

11. Apparatus in accordance with claim 10 wherein said adjusting means includes a yoke assembly and a pair of hydraulic cylinders, said other portion of said leg assembly being connected to said yoke, each of the cylinders of said pair of hydraulic mechanisms being connected to said truck frame and each piston of said pair of hydraulic piston-cylinder mechanisms being connected to said yoke assembly whereby the motion of said pistons with respect to said cylinders adjusts the position of said truck frame with respect to said framework.

12. Apparatus in accordance with claim 1, 2 or 3 wherein said tool is comprised of a plowing device having a plurality of plow blades for removing ballast to the side of a railway roadbed.

13. Apparatus in accordance with claim 12 wherein a tow ear is secured to each side of said plow for coupling said plow to a device for towing said plow, each tow ear being pivotably attached to said plow for pivoting motion between a position wherein each ear extends laterally from a side of the plow for coupling to a towing device and a transport position wherein each ear is pivoted inwardly from its laterally outward extending position for transport in its suspended position beneath said framework, and means for locking each ear to its laterally outward extending position.

14. Apparatus in accordance with claim 12 wherein said plow includes a control pad disposed at the rear of said plow and extending laterally across the entire width of said plow, and means for adjusting the vertical position of said control pad with respect to the remaining portion of said plow independently on either lateral side of said control pad.

15. Apparatus in accordance with claim 1, 2 or 3 wherein said tool is comprised of a sled device having a set of blades for leveling ballast beneath the track.

16. Apparatus in accordance with claim 15 wherein a tow ear is secured to each side of said sled for coupling said sled to a device for towing said sled, each tow ear being pivotably attached to said sled for pivoting motion between a position wherein each ear extends laterally from a side of the sled for coupling to a towing device and a transport position wherein each ear is pivoted inwardly from its laterally outward extending position for transport in its suspended position beneath said framework, and means for locking each ear to its laterally outward extending position.

17. Apparatus in accordance with claim 15 wherein said sled includes a control pad disposed at the rear of said sled and extending laterally across the entire width of said sled, and means for adjusting the vertical position of said control pad with respect to the remaining portion of said sled independently on either lateral side of said control pad.

18. Apparatus for performing work on a railway roadbed with a roadbed working tool, such as a plow or sled, comprising:

a mobile support framework;

a front truck and a rear truck, each truck rotatably supporting wheels for riding on rails of a railway track;

means for connecting said trucks in longitudinally spaced relationship to said framework;

rail hook means carried by said framework for selectively connecting said framework with the rails upon which the wheels are riding;

means carried by said framework for raising said framework and a section of rail connected to said framework by said rail hook means with respect to the ground;

suspension means located between said trucks for selectively suspending a roadbed working tool from said framework for transport therewith; and powered handling boom means supported by said framework for manipulating said tool with respect to said framework and railway track after said tool has been released from said framework by said suspension means.

19. Apparatus for performing work on a railway roadbed with a roadbed working tool, such as a plow or sled, comprising:

a mobile support framework;

a plurality of wheels coupled to said framework for riding on rails of a railway track;

rail hook means carried by said framework for selectively connecting said framework with the rails upon which the wheels are riding;

means carried by said framework for raising said framework and a section of rail connected to said framework by said rail hook means with respect to the ground;

suspension means for selectively suspending said tool from said framework;

motor means for moving said suspension means between a tool supporting position wherein said tool is suspended from said framework and a release position wherein said tool is free to drop from said framework; and powered handling boom means supported by said framework for moving said tool with respect to said framework after said tool has been released from said framework by said suspension means.

20. Apparatus in accordance with claim 19 wherein said motor means includes first and second hydraulic piston-cylinder mechanisms, said first hydraulic piston-cylinder mechanism having a cylinder connected to said framework and a piston rod connected to said rod supporting said first pair of hooks through a crank arm for converting the extending and retracting motion of said piston rod within said cylinder to rotary motion of the rod supporting said first pair of hooks, and said second hydraulic piston-cylinder mechanism having a second cylinder connected to said framework and a second piston rod coupled to said rod supporting the second pair of hooks through a second crank arm for converting the extending and retracting motion of said last-mentioned piston rod into rotary motion of the rod supporting the second pair of hooks.

21. Apparatus for performing work on a railway roadbed with a roadbed working tool, such as a plow or sled, comprising:

a mobile support framework;

a plurality of wheels coupled to said framework for riding on rails of a railway track;

rail hook means carried by said framework for selectively connecting said framework with the rails upon which the wheels are riding;

means carried by said framework for raising said framework and a section of rail connected to said framework by said rail hook means with respect to the ground;

suspension means for selectively suspending said tool from said framework;

said suspension means including a first pair of hooks fixedly attached to a rod for rotation therewith, a second pair of hooks fixedly attached to a second rod for rotation therewith, and means for supporting said first and second rods for rotary motion below said framework at spaced locations along the length of said framework; and powered handling boom means supported by said framework for moving said tool with respect to said framework after said tool has been released from said framework by said suspension means.

22. Apparatus for performing work on a railway roadbed with a roadbed working tool, such as a plow or sled, comprising:

a mobile support framework;

a plurality of wheels coupled to said framework for riding on rails of a railway track;

rail hook means carried by said framework for selectively connecting said framework with the rails upon which the wheels are riding;

means carried by said framework for raising said framework and a section of rail connected to said framework by said rail hook means with respect to the ground;

suspension means for selectively suspending said tool from said framework; and powered handling boom means supported by said framework for moving said tool with respect to said framework after said tool has been released from said framework by said suspension means;

said handling boom means including a generally vertically extending support member, means for rotatably carrying said support member on said framework for rotation about a generally vertical axis, arm means pivotably connected to said support member for pivoting about a generally horizontal axis, coupling means attached to said arm means for coupling said boom means to said tool, first power drive means for rotating said support member, and second power drive means for pivoting said arm means about its axis.

23. Apparatus in accordance with claim 22 wherein said first power drive means includes a gear connected to said support member for rotation therewith, a length of chain passed about a portion of said gear, and means for moving said chain with respect to said gear to rotate said gear and the attached support member.

24. Apparatus in accordance with claim 23 wherein said gear is attached to a coupling tube, said coupling tube being removably secured to the remaining portion of said support member.

25. Apparatus in accordance with claim 23 wherein said means for moving said chain includes a pair of hydraulic piston-cylinder mechanisms, a first end of said chain being connected to the piston rod of one of said hydraulic piston-cylinder mechanisms, and the other end of said chain being connected to the piston rod of the other hydraulic piston-cylinder mechanism, whereby the motion of said pistons moves said chain to rotate said support member.

26. Apparatus in accordance with claim 22 or 23 wherein said arm means includes a boom pivotably connected to said support member for pivoting motion about a generally horizontal axis, a jib pivotably connected to said boom at a location distant from the pivotal connection of said boom to said support member for pivotable motion about a generally horizontal axis, and said second power drive means includes a boom hydraulic piston-cylinder mechanism connected between said support member and said boom for pivoting said boom with respect to said support member and a jib hydraulic piston-cylinder mechanism connected between said boom and said jib for pivoting said jib with respect to said boom.

27. Apparatus in accordance with claim 26 wherein said coupling means includes a fork pivotably connected to said jib, a tilt hydraulic piston-cylinder mechanism for pivoting said fork with respect to said jib about a generally horizontal axis.

28. Apparatus in accordance with claim 27 including a clamping means for selectively clamping a tool engaged by said fork.

29. Apparatus in accordance with claim 28 wherein said fork includes a pair of laterally spaced fork arms, said clamping means including a pivotable clamp disposed laterally inward of each fork arm and means for pivoting each of said clamps between a clamping and unclamping position.

30. Apparatus for performing work on a railway roadbed with a roadbed working tool, such as a plow or sled, comprising:

a mobile framework;

a front support truck and a rear support truck disposed in longitudinally spaced relationship, each of said trucks including a base portion and a movable portion mounted for lateral motion relative to the base portion with the movable truck portions rotatably supporting wheels for riding on rails of a railway track;

means including powered raising/lowering mechanisms for connecting each truck to said framework;

rail hook means carried by said framework for selectively connecting said framework with the rails upon which said wheels are riding;

means carried by said framework for raising said framework and a section of rail connected to said framework by said rail hook means with respect to the ground; and adjusting means connected between the base and movable portions of each truck for selectively moving the movable portion of each of said trucks laterally with respect to the associated base truck portion and the lengthwise dimension of said framework to effect alignment between the wheels of said trucks and the rails of the track.

31. Apparatus in accordance with claim 30 wherein said connecting means includes a leg assembly having one portion pivotably connected to said framework and another portion connected to the base portion of each truck through said adjusting means.

32. Apparatus in accordance with claim 31 wherein said adjusting means includes motor means connected between the movable portion of each truck and said other portion of said leg assembly for moving said movable truck portion with respect to said leg assembly in a direction transverse to the lengthwise dimension of said framework.

33. Apparatus for performing work on a railway roadbed, comprising:

a mobile support framework;

a front truck and a rear truck, each of said trucks rotatably supporting wheels for riding on rails of a railway track;

means for connecting each truck to said framework;

each of said trucks including a truck frame and at least one axle carried by each truck frame for supporting said wheels, and said connecting means including a leg assembly having one portion pivotably connected to said framework and another portion connected to one of said truck frames through said adjusting means;

rail hook means carried by said framework for selectively connecting said framework with the rails upon which said wheels are riding;

means carried by said framework for raising said framework and a section of rail connected to said framework by said rail hook means with respect to the ground; and adusting means for moving each of said trucks laterally with respect to the lengthwise dimension of said framework, said adjusting means including motor means connected between said truck frame and said other portion of said leg assembly for moving said truck frame with respect to said leg assembly in a direction transverse to the lengthwise dimension of said framework;

said adjusting means further including a yoke assembly and said motor means including a pair of hydraulic piston-cylinder mechanisms, said other portion of said leg assembly being connected to said yoke, each of said hydraulic piston-cylinder mechanisms having a cylinder connected to said truck frame and a piston connected to one arm of said yoke assembly whereby the motion of said piston with respect to said cylinders adjusts the position of said truck frame with respect to said leg assembly and framework.

34. A tool for working ballast material below a lifted section of railway track, said tool comprising:

a support frame;

blade means extending transversely below said support frame for working the ballast material;

a transverse plate disposed behind said blade means and extending below said support frame across substantially the entire width of the railway track, said plate having an upturned front edge; and a pair of control mechanisms connected in laterally spaced relationship between said plate and support frame, each control mechanism including:

a pair of longitudinally spaced links swingably supporting said plate from said frame; and means for selectively adjusting the position of said plate relative to said frame.

35. Apparatus in accordance with claim 34 wherein said tool is a plow and said blade means are plow blades for plowing ballast out from beneath the lifted track to one or both sides of said track.

36. Apparatus in accordance with claim 34 wherein said tool is a sled and said blade means is a set of sled blades for leveling ballast material beneath the elevated track.

37. A tool for moving ballast material below a lifted section of railway track, said tool comprising:

a support frame;

blade means extending below said support frame for moving ballast material;

a control pad mechanism extending below said support frame rearward of said blade means, said control pad mechanism including a pad extending laterally across substantially the entire width of the track with which said tool is to be used;

means for independently adjusting the space between the support frame and the pad on either side of said pad whereby the level at which said blades move the ballast material is adjustable in said lateral direction; and a tow ear secured to each side of said tool for coupling said tool to a device for towing said tool, each tow ear being pivotably attached to said tool for pivoting motion between a position wherein each ear extends laterally from a side of the tool for coupling to a towing device and a transport position wherein each ear is pivoted inwardly from its laterally outward extending position for transport, and means for locking each ear to its laterally outward extending position.

38. A tool for moving ballast material beneath a lifted section of railway track, said tool comprising:

a support frame;

blade means for moving the ballast material;

a tow ear secured to each side of said support frame for coupling said tool to a device for towing said tool, each tow ear being pivotably attached to said support frame for pivoting motion between a position wherein each ear extends laterally from a side of the tool for coupling to a towing device and a transport position wherein each ear is pivoted inwardly from its laterally outward extending position for transport, and means for locking each ear to its laterally outward extending position.

39. A track skeletonizer, comprising:

a mobile support framework;

a front truck and a rear truck, each truck rotatably supporting wheels for riding on rails of a railway track;

means for connecting said trucks in longitudinally spaced relationship to said framework;

hook means mounted on said framework for selective connection with the rails;

outrigger means mounted on said framework for selectively raising said framework and a section of rail connected thereto by said hook means relative to the ground;

means for coupling a roadbed working tool to said frame in an operative position beneath a raised section of rail for movement therewith to perform work on a railway roadbed; and powered handling boom means mounted on said framework for positively manipulating the tool to and from the operative position, said boom means including:

a base;

arm means pivoted at one end to said base;

means for selectively effecting pivotal movement of said arm means; and means mounted on the other end of said arm means for selectively engaging the tool for manipulation by said boom means.

40. The track skeletorizer of claim 39, wherein each track includes a base portion and a movable portion mounted for lateral motion relative to the base portion, the wheels being mounted on the movable truck portion, and further including:

adjusting means connected between the base and movable portions of each truck for selectively moving the movable portion of each truck relative to the associated base truck portion to effect alignment between the wheels and rails.

41. The truck skeletorizer of claim 39, further including:

means for selectively suspending the roadbed working tool from said framework in an inoperative position above the rails for transport therewith.

42. A track skeletonizer, comprising:

a mobile support framework;

a front truck and a rear truck, each truck rotatably supporting wheels for riding on rails of a railway track;

means for connecting said trucks in longitudinally spaced relationship to said framework;

hook means mounted on said framework for selective connection with the rails;

outrigger means mounted on said framework for selectively raising said framework and a section of rail connected thereto by said hook means relative to the ground;

means for coupling a roadbed working tool to said frame in an operative position beneath a raised section of rail for movement therewith to perform work on a railway roadbed; and powered handling boom means mounted on said framework for positively manipulating the tool to and from the operative position, said boom means including:

a base supported for rotation about a generally vertical axis;

means for selectively effecting rotation of said base;

arm means pivoted at one end to said base about a generally horizontal axis;

means for selectively effecting pivotal movement of said arm means; and means mounted on the other end of said arm means for selectively engaging the tool for manipulation by said boom means.

* * * * *